United States Patent [19]

Stevens

[11] Patent Number: 4,970,437

[45] Date of Patent: Nov. 13, 1990

[54] CHOPPER FOR CONVENTIONAL BALLAST SYSTEM

[75] Inventor: Carlile R. Stevens, Alamo, Calif.

[73] Assignee: Motorola Lighting, Inc., Schaumburg, Ill.

[21] Appl. No.: 377,379

[22] Filed: Jul. 10, 1989

[51] Int. Cl.[5] ..... H05B 37/02

[52] U.S. Cl. ..... 315/209 R; 315/DIG. 7; 315/287; 315/224

[58] Field of Search ..... 315/DIG. 7, 209 R, 287, 315/224, 208, 289, 101, 103

[56] References Cited

U.S. PATENT DOCUMENTS

| | | | |
|---|---|---|---|
| 3,619,716 | 11/1971 | Spira | 315/244 |
| 3,896,336 | 7/1975 | Schreiner | 315/226 |
| 3,906,302 | 9/1975 | Wijsboom | 315/289 |
| 3,913,002 | 10/1975 | Steigerwald | 321/2 |
| 4,005,337 | 1/1977 | Rabe | 315/224 |
| 4,358,711 | 11/1982 | Bex | 315/208 |
| 4,375,608 | 3/1983 | Kohler | 315/307 |
| 4,388,563 | 6/1983 | Hyltin | 315/205 |
| 4,410,837 | 10/1983 | Suzuki et al. | 315/289 |
| 4,672,300 | 6/1987 | Harper | 323/222 |
| 4,728,865 | 3/1988 | Daniels | 315/224 |
| 4,728,866 | 3/1988 | Capewell et al. | 315/224 |
| 4,766,350 | 8/1988 | Hûsgen et al. | 315/DIG. 7 |
| 4,803,406 | 2/1989 | Yasuda et al. | 315/DIG. 7 |
| 4,818,917 | 4/1989 | Vest | 315/208 |
| 4,904,903 | 2/1990 | Pacholok | 315/DIG. 7 |
| 4,906,899 | 3/1990 | Hope et al. | 315/101 |

*Primary Examiner*—Eugene R. LaRoche
*Assistant Examiner*—Amir Zarabian
*Attorney, Agent, or Firm*—Paul F. Wille

[57] ABSTRACT

A chopper circuit is series connected between a conventional ballast and the fluorescent lamps to provide a high frequency current to the lamps to increase and adjust the luminance thereof. The chopper circuit comprises a diode bridge with a transistor connected across the DC terminals thereof. The lamps are series connected with the AC terminals. A photocell is used in a feedback circuit to maintain constant lighting.

8 Claims, 2 Drawing Sheets

CHOPPER FOR CONVENTIONAL BALLAST SYSTEM

BACKGROUND OF THE INVENTION

1. Field of the Invention

This invention relates to ballasts for fluorescent lamps and, in particular, to a low cost apparatus for addition to conventional fluorescent fixtures for selectively increasing or decreasing light output.

2. Brief Description of the Prior Art

It has been well known for many years that high frequency current will operate a fluorescent lamp more efficiently, i.e. more light will be produced for the same amount of energy. In recent years, solid state ballasts have been developed that drive the lamps at high frequency and provide a significant energy saving. U.S. Pat. Nos. 4,277,728, 4,563,616 and 4,684,850 describe systems for adjusting the light level in order to maintain adequate light while using a minimum of energy.

In general, one can adjust light output by controlling either the frequency or power to the lamp. In the prior art, power to the lamp is varied via pulse width modulation, of either the line frequency or a high frequency obtained from a converter-inverter system.

It is also known to provide what can be considered a quasi-high frequency by chopping the voltage from the power line, e.g. U.S. Pat. No. 3,619,716. In this patent, the chopper is described as in series with lamp and its heaters.

In U.S. Pat. No. 3,913,002, an NPN transistor is in series with the ballast inductor, the lamp, and a current sensor. The line current per se is not chopped. Instead, a rectified, filtered current is chopped.

In U.S. Pat. No. 4,353,711, the chopper circuit is disclosed as connected to the DC terminals of a diode bridge, while the AC terminals of the bridge connected in series with the lamp. As with the previously noted patents, the heaters are subjected to the chopped current, which often causes problems during dimming.

It is also known to provide a bidirectional switch by connecting a transistor across the DC diagonal of a diode bridge, e.g. as in U.S. Pat. No. 4,375,608 and in the '002 patent already noted.

Further, it is known to use a photodiode in the negative feedback path of an inverter type of ballast; U.S. Pat. No. 4,672,300 (FIG. 3).

Some of these systems require replacement of existing ballasts with the new system, a cost many customers are unwilling to bear. In view of this, customers have turned to other means to save energy in applications where lighting reductions could be tolerated. These have involved removing some of the lamps from the fixtures, often resulting in uneven lighting conditions, turning off some lamps, relying instead on daylight, or installing small devices called "light reducers", between the ballast and lamp. Light reducers lower the lamp luminance by a predetermined, fixed amount.

This method of fixed light reduction is accomplished by the use of a capacitive reactance between the lamp and ballast, which has been found to have an adverse effect on some ballasts, causing excess heating or unpredictable performance. In some cases the wave shape of the current flowing through the lamp (crest factor) is altered enough to shorten lamp life. Crest factor is the ratio of the peak amplitude of the lamp current to the r.m.s. value of lamp current.

In view of the foregoing, it is therefore an object of the present invention to improve the efficiency of a conventionally ballasted lamp.

It is a further object of the present invention to provide a means for controlling the light output from a conventionally ballasted fluorescent lamp without subjecting the lamp heaters to reduced current.

In accordance with another aspect of the present invention, it is an object to enable the luminance of the lamp to be adjusted by either local or remote means.

In accordance with another aspect of the present invention, it is an object to make the fixture responsive to ambient light so that relatively constant illumination is available automatically.

SUMMARY OF THE INVENTION

The foregoing objects are achieved in the present invention wherein a solid state switching device is interposed between a conventional ballast and the lamp(s) to interrupt the current flow through the lamp(s) at a high frequency. The heater circuit is unaffected. The high frequency increases the luminance of the lamp. By varying the duty cycle of the high frequency current, the amount of energy delivered to the lamp can be controlled. The light output can be adjusted over a range between ten and one hundred and fifteen percent of a conventional system. Control means, including photocell feedback, are provided or adjusting or maintaining light level.

BRIEF DESCRIPTION OF THE DRAWING

A more complete understanding of the present invention can be obtained by considering the following detailed description in conjunction with the accompanying drawings, in which.

DETAILED DESCRIPTION OF THE INVENTION

Figure 1:
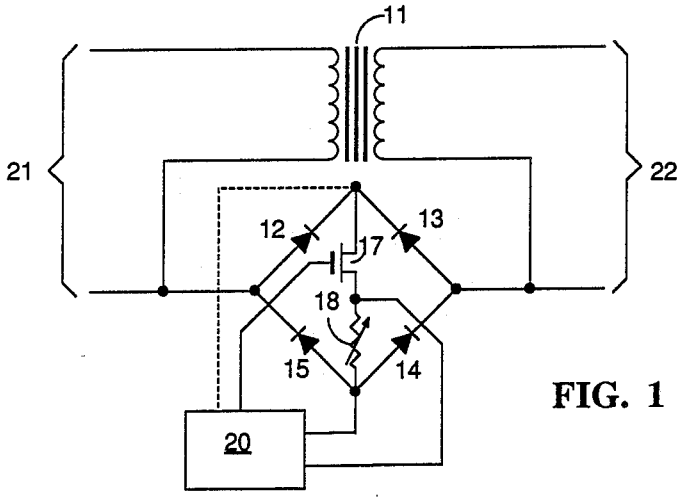
FIG. 1 illustrates a preferred embodiment of a circuit in accordance with the present invention.

FIG. 1 illustrates a preferred embodiment of the present invention wherein a discontinuity is placed in the current loop through the lamps. Specifically, one pair of heater wires is cut and the circuit of the present invention is inserted. Input 21 is connected to a pair of heater wires from a conventional ballast. Output 22 is connected to the heater of one end of the lamps. Transformer 11 is interposed in the heater circuit to block the flow of current through the lamps. Transformer 11 is merely an isolation transformer which enables the heaters to function normally, but renders the lamps inoperative.

Connected in parallel with transformer 11 is a bridge circuit comprising diodes 12-15. The AC terminals of the bridge are connected to one wire each from input 21 and output 22. The DC terminals of the bridge are interconnected by a series circuit comprising MOSFET switch transistor 17 and non-inductive, variable resistor 18. The gate of transistor 17 is connected to a source 20 of high frequency pulses. As indicated by the dashed line, power for circuit 20 can be taken from the DC diagonal of the bridge.

When transistor 17 is turned on, current flows to the lamps through the bridge. When transistor 17 is off, no current flows to the lamps. Thus the AC line signal is chopped by the bridge circuit, providing a high frequency drive to the lamps, which increases the efficiency of the lamps. Although the lamps are not driven directly by a high frequency, as with a solid state ballast, the high frequency switching of the current from the conventional ballast has a similar effect in improving the lamp efficiency. This circuit can vary the light output between ten and one hundred fifteen percent of that light provided in the absence of the present invention by using pulse width modulation of the signal to the gate electrode of transistor 17.

The voltage drop across resistor 18 provides a feedback signal to source 20 proportional to the amount of current flowing in the lamps at any time. This feedback voltage maintains a constant average lamp current, in spite of variations of line voltage or lamp aging, by varying the duty cycle of the high frequency signal. In a preferred embodiment of the present invention, resistor 18 is variable. This enables the user to change the light level. Circuit 20 then maintains the light output at the level set by the user. Circuit 20 can comprise any of a variety of pulse width modulation circuits, well know per se in the art. With present technology, it could comprise little more than a single integrated circuit, e.g. MC34060, and some peripheral components.

Once a lamp has been lit, the voltage handled by the switching device is quite low, enabling the use of inexpensive, readily available devices. During starting or lamp malfunction, very high voltages can occur. To prevent damage to the switching device, the feedback from resistor 18 assures that when no current is flowing through the lamps, the switching device is turned full on (one hundred percent duty cycle) and none of the high voltage will appear across it since the voltage drop across transistor 17 is less than one volt in the on condition.

Figure 2:
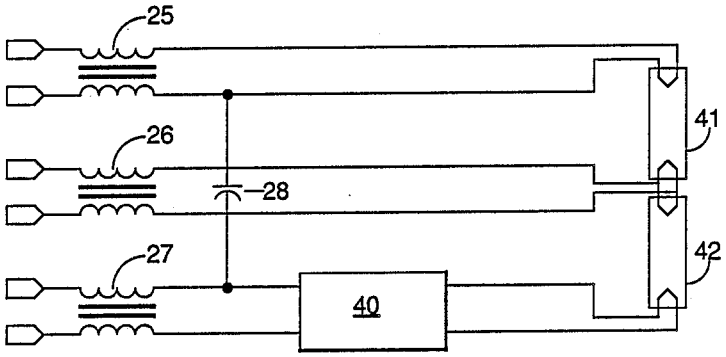
FIG. 2 illustrates a lighting system in accordance with the present invention.

FIG. 2 illustrates the use of the present invention in a conventional two lamp system. Transformers 25, 26 and 27 acting with capacitor 28 block any high frequency signal generated by the switching device from coupling back into the ballast where it would be wasted as heat. Also, the conventional ballast has a large capacitor normally connected between the yellow pair and the blue pair (the middle and lower pairs in FIG. 2) of wires as an aid in starting the lamps. This capacitor is isolated by transformers 25–27; otherwise, the light from one lamp would be much less the light from the other. Circuit 40 is the circuit illustrated in FIG. 1. Lamps 41 and 42 are series connected so that the lamp current is interrupted by circuit 40 as described above.

Capacitor 28 primarily provides an energy absorbing function. Specifically, when circuit 40 is not conducting, the lamps are not conducting, and the applied current flows through capacitor, charging it. When lamps 41 and 42 are conducting, current is also provided by capacitor 28 as it discharges through the lamps. While it may seem that doubling the current through the lamps and having a fifty percent duty cycle would average out to the same performance as without the present invention, such is not the case in practice. For one thing, the current is not doubled. Secondly, the luminance of the lamps increases at higher frequencies. Maximum luminance (one hundred fifteen percent of normal) is obtained at approximately sixty percent duty cycle.

Duty cycle is determined, in part, by the current through the lamps. Resistor 18 provides a variable voltage signal proportional to the current through the lamps. This voltage signal can be used alone for stabilizing lamp luminance or combined with a signal from a remote source indicative of a request for a certain amount of light. By varying the value of resistor 18, one changes the operating point of the system and dims or brightens the lamps. Left unchanged, resistor 18 provides a negative feedback which stabilizes the current through the lamps.

Figure 3:
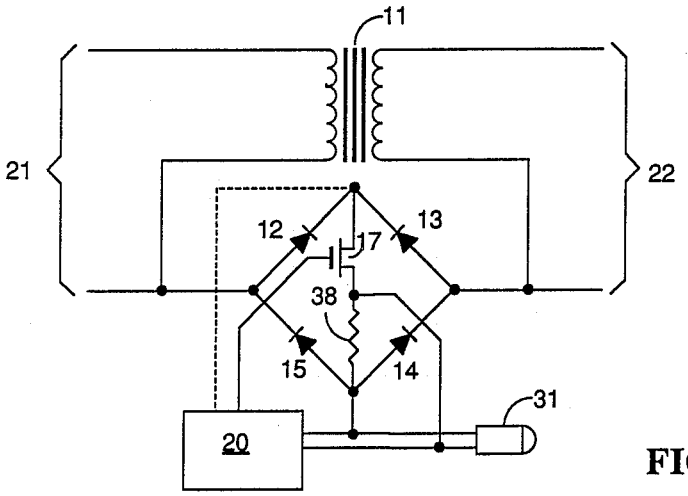
FIG. 3 illustrates an alternative embodiment of the present invention in which a photocell is used to control lamp luminance.

As illustrated in FIG. 3, the variable voltage input to source 20 comprises a signal from photocell 31, which is positioned to measure ambient light, i.e. the total light in the area illuminated by lamps 41 and 42. In this embodiment, resistor 38 is of fixed value and serves primarily in regulating current during lamp starting. The signal from resistor 38 is combined with that of photocell 31 to determine the duty cycle and, hence, the current through the lamps. Instead of being combined as shown, a summation network or an operational amplifier can be used to combine the signals. The embodiment of FIG. 3 is otherwise the same as that of FIG. 1 and operates in the same way.

Figure 4:
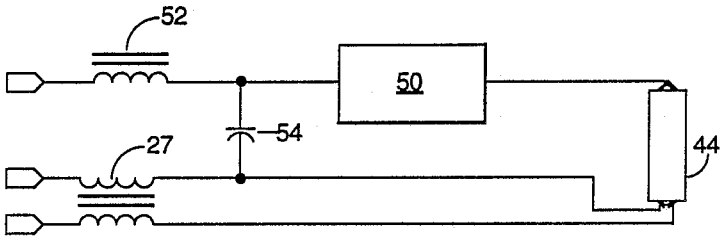
FIG. 4 illustrates the present invention in use with what are known as instant start lamps.

FIG. 4 illustrates the use of the present invention in a lighting system using an instant start lamp. In this configuration, there is no need for transformer 11 since there are no heaters in the lamp. Circuit 50 is otherwise the same as the circuits of either FIGS. 1 or 3. Inductor 52, transformer 27, and capacitor 54 prevent coupling of the high frequency from circuit 50 to the conventional ballast. Capacitor 54 operates as does capacitor 28 to store energy when the lamps are not conducting and to increase the current through the lamps when they do conduct.

There is thus provided by the present invention a simple, inexpensive, yet effective means to increase the efficiency and flexibility of conventional lighting systems. The components are readily available and inexpensive. Diodes 12–15 comprise MR812 diodes, transistor 17 comprises a P364 MOSFET, as sold by SGSThomson, and transformers 25–27 comprise conventionally wound inductors.

While a preferred embodiment has been shown and described, it will be apparent to those skilled in the art that various changes and modifications can be made within the scope of the present invention. For example, while a MOSFET is preferred for its rapid switching characteristics, other semiconductor switching devices can be used instead. Photocell 31 can be positioned to monitor the luminance of the lamps rather than the illumination of the room in which the lamps are used.

I claim:

1. In a chopper circuit for connection between a ballast and a fluorescent lamp having heaters, said circuit having a diode bridge circuit having AC and DC terminals, switch means connected to said DC terminals, means for connecting said AC terminals in series with said fluorescent lamp, energy storage means connected in parallel with said AC terminals and said fluorescent lamp, and control means connected to said switch means for actuating said switch means at a frequency above power line frequency, the improvement comprising:

transformer means having a primary winding and a secondary winding;

wherein the AC terminals of said bridge interconnect said primary winding and said secondary winding, forming a series circuit with said windings when said switch means is conducting; said transformer means inductively coupling around said switch means when said switch means is not conducting, thereby providing filament power to said lamp.

2. The apparatus as set forth in claim 1 wherein said switch means comprises a transistor and a resistor series connected to said DC terminals.

3. The apparatus as set forth in claim 2 wherein the junction of said transistor and resistor is connected to an input of said control means for varying the duty cycle of said switch means.

4. The apparatus as set forth in claim 3 and further comprising photocell means connected to said control means for sensing the illumination from said lamp.

5. Apparatus for connection between a ballast and a fluorescent lamp comprising:

a diode bridge circuit having AC and DC terminals defining first and second diagonals of said bridge;

semiconductor switch means and a non-inductive resistor series connected to said DC terminals;

means for connecting one of said AC terminals to said ballast and the other of said AC terminals to one end of said fluorescent lamp;

energy storage means connected to said one AC terminal and the other end of said fluorescent lamp; and control means having an output thereof connected to said switch means for actuating said switch means at a frequency above power line frequency and having an input thereof connected to the junction of said switch means and said resistor for receiving a signal indicative of current through said lamp.

6. The apparatus as set forth in claim 5 wherein said control means varies the duty cycle of said switch means in response to said signal.

7. The apparatus as set forth in claim 5 and further comprising photocell means for sensing the illumination from said lamp, wherein the output of said photocell means is also connected to the input of said control means.

8. The apparatus as set forth in claim 7 wherein said control means varies the duty cycle of said switch means in response to said signal and the output from said photocell means.

* * * * *